United States Patent [19]

Vogler et al.

[11] 4,208,584

[45] Jun. 17, 1980

[54] CIRCUIT ARRANGEMENT FOR AN X-RAY GENERATOR

[75] Inventors: Gerd Vogler; Heinz Mester, both of Hamburg, Fed. Rep. of Germany

[73] Assignee: U.S. Philips Corporation, New York, N.Y.

[21] Appl. No.: 874,527

[22] Filed: Feb. 2, 1978

[30] Foreign Application Priority Data

Apr. 30, 1977 [DE] Fed. Rep. of Germany ..... 2719373

[51] Int. Cl.² ..... H05G 1/10

[52] U.S. Cl. ..... 250/402; 250/413; 250/421

[58] Field of Search ..... 250/401, 402, 413, 421, 250/422, 418

[56] References Cited

U.S. PATENT DOCUMENTS 2,420,845 5/1947 Slack ..... 250/418

3,130,312 4/1964 Craig ..... 250/413

4,099,056 7/1978 Franke ..... 250/413

*Primary Examiner*—Craig E. Church

*Attorney, Agent, or Firm*—Thomas A. Briody; William J. Streeter; Bernard Franzblau

[57] ABSTRACT

A circuit to avoid excess voltages when the high voltage transformer of an X-ray generator is switched on. The circuit includes a second thyristor connected in series with a damping resistor and coupled in parallel with the starting thyristor for the X-ray tube. Said second thyristor is turned on simultaneously with the high-voltage starting signal, while the first (starting) thyristor (without a series-connected resistor) is turned on with a certain delay. This delay increases as the tube current decreases. Thus, excessive voltages during switching on can be eliminated independently of the value of the tube current with the addition of only a single damping resistor and a thyristor.

8 Claims, 7 Drawing Figures

CIRCUIT ARRANGEMENT FOR AN X-RAY GENERATOR

Figure 1:
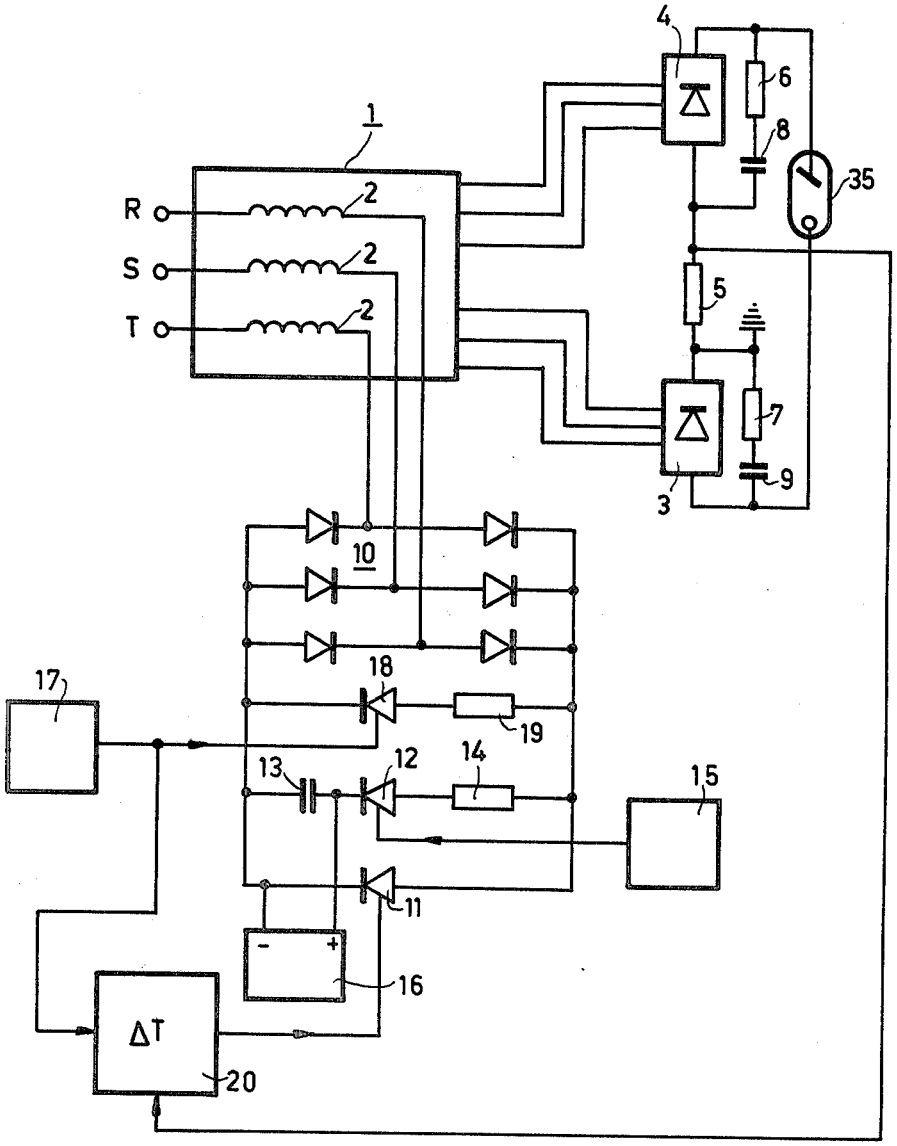

The invention relates to a circuit arrangement for an X-ray generator, comprising at least a first electronic switch for switching on the tube voltage, which switch is included in the primary circuit of the high-voltage transformer of the X-ray tube. Such a circuit arrangement is known (DT-PS No. 15 63 553; FIG. 1). In this circuit the primary windings of a three-phase transformer are switched on via a three-phase rectifier bridge circuit and a thyristor which serves as an electronic switch, which thyristor is included in the diagonal branch of the rectifier bridge circuit.

When the high voltage transformer is switched on the inevitable capacitances in the high-voltage generator and the stray inductance of the high-voltage transformer produce transient effects which temporarily cause the tube voltage to increase beyond the preset value. The magnitude of the excess voltage thus produced decreases with increasing tube current.

In order to avoid such overshoot it is known to include resistors in the lines to the primary windings of the high-voltage transformer. Depending on the tube current setting one of these resistors is included in the line to the primary winding for a specific time interval at the beginning of the exposure. By suitably proportioning the resistors to be included in the input lines in the different current ranges the excess voltages can be eliminated for all tube currents.

However, this solution is very intricate. The resistors to be included in the primary circuit should be designed to handle high loads because during an X-ray exposure they may have to pass a few hundred Amps. for a short time. The contactors by which the resistors are connected should have corresponding current or power ratings. However, such resistors and contactors are very expensive.

Moreover, the known solution is economically justified only in those X-ray generators which comprise a separate tube current control. In X-ray generators without such a control, in which the tube current is controlled automatically depending on the tube-voltage setting, the rated load of the X-ray tube and, as the case may be, the exposure time, the inclusion of resistors depending on the tube current, which is the result of the specified values of tube voltage, tube load, etc., is impracticable.

It is an object of the present invention to provide a circuit arrangement of the type mentioned in the preamble which in an advantageous and simple manner suppresses excess voltages when the high voltage is switched on.

In accordance with the invention this problem is solved in that the series connection of a second electronic switch and a resistor is connected in parallel with the first electronic switch. The second switch can be activated by the high-voltage starting signal and the first switch can be activated by the output signal of a timing network. The latter network is started by the high-voltage starting signal and is designed so that the delay time between the high-voltage starting signal and its output signal is greater for a small current in the high-voltage circuit than it is for a large current.

The current in the high voltage circuit is the result of the current component through the X-ray tube and the current component through any filter elements, voltage dividers etc. in the high-voltage circuit. The last-mentioned current component is constant for a specific high voltage and therefore it suffices when only the tube current, which is adjustable within wide limits (for example from 10 mA–1500 mA) is covered. If desired, the constant current component may also be included.

In the circuit arrangement in accordance with the invention the resistor which is connected in series with the second electronic switch remains connected in the primary circuit of the high-voltage transformer for a relatively long time for small tube currents, whereas for average or larger tube currents it is connected for a relatively short time only and under certain conditions not at all. In order to eliminate excess voltages in conventional X-ray generators, the value of the resistor which is included in the primary circuit is changed depending on the tube current (this resistor being included for a constant time), whereas in accordance with the invention the time during which the resistor, which has the same value for all tube currents, is included in the primary circuit is changed depending on the tube current in such a way that this time interval decreases for increasing tube current. Therefore, in addition a power resistor and an electronic power switch are required in accordance with the invention. This second electronic switch may have a lower rating than the first electronic switch because the current flowing through it is limited by the resistor connected in series with it and because it is loaded practically speaking only until the first electronic switch is switched on. The further components which are needed, in particular those of the timing element, are not loaded by the current in the primary circuit. Therefore, inexpensive components with a lower current rating may be used.

The time interval during which the resistor which is connected in series with the second electronic switch is included in the primary circuit, and which is equal to the delay time between the high voltage starting signal and the output signal of the timing element, can essentially be varied depending on the tube current in two different ways.

The delay time is controlled depending on the tube current setting. This value is already determined before the high voltage is switched on and is set either directly by a control for the tube current or indirectly by another control, for example the tube voltage control and the focus spot selector. One or more time-determining elements included in the timing network, for example a variable resistor or a plurality of resistors or capacitors, one of which can be selectively connected depending on the tube current setting, may be coupled to said controls. A particularly simple construction of a timing network of this type is obtained in accordance with a variant of the invention in that the timing network comprises a plurality of impedance elements individually selected to determine the delay time, so that each time one element can be connected in the network by means of the tube current control.

The second way of varying the time interval during which the resistor in series with the second electronic switch is connected in the high-voltage circuit depending on the tube current is to measure the tube current or the current in the high-voltage circuit and to change the time interval depending on the measured current. Such a measurement is possible only after the high voltage has been switched on because prior to this there is no tube current. In a variant using this principle the timing network comprises a comparator circuit which produces the output signal for activating the first switch and which compares the charging or discharging voltage across a capacitor with a reference voltage. In this variant either the potential on the low end of the capacitor or the reference voltage is variable by an amount which is proportional to the current measured in the high-voltage circuit of the X-ray generator or the tube current.

The value of the resistor in series with the second electronic switch may be comparatively low if, in accordance with a variant of the invention, a filter network consisting of the series connection of a resistor and a capacitor is connected to the output of the high-voltage rectifier circuit. When this high voltage RC network is proportioned so that a time constant of the order of magnitude of the transient duration is obtained and the resistor has such a value that the charging current flowing at the starting instant substantially corresponds to the average tube current (approx. 100 mA in the case of an X-ray generator for tube currents between 10 A and 1.5 mA), a current corresponding to the average tube current will flow in the high voltage circuit at the beginning of X-ray exposures with a small tube current, while the greater part flows via the RC element and not via the X-ray tube. Therefore, the magnitude of the excess voltages is substantially independent of the value of the tube current in the lower tube current range. Thus, it becomes particularly simple to proportion the timing network and the resistor so that excess voltages can be suppressed uniformly at all tube current values.

In principle, the delay time between the activation of the two switches should not exceed the duration of the transient effect (approx. 2 msec). However, in X-ray generators with a filter network, whose time constant is shorter than the transient duration, longer delay times are also permissible (though not required) for tube currents which are so small that they produce no significant voltage drop across the resistor. For tube currents which are so large that substantially no overshoot occurs, the delay time should be minimal. If the delay time is too great, or when the resistance is too high, the starting voltage will vary stepwise.

Figure 2A:
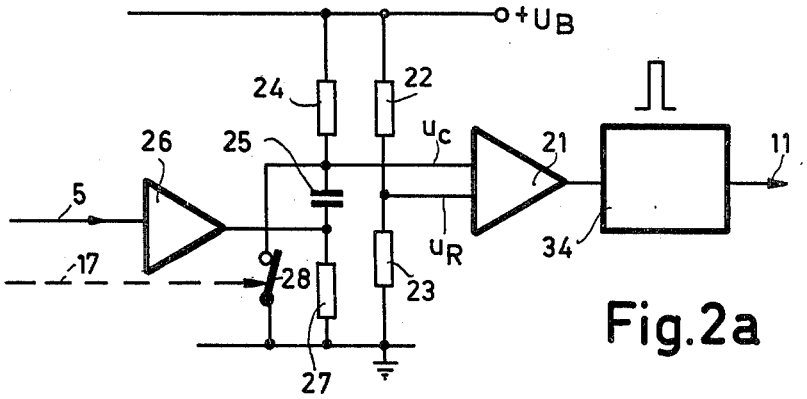
Figure 2B:
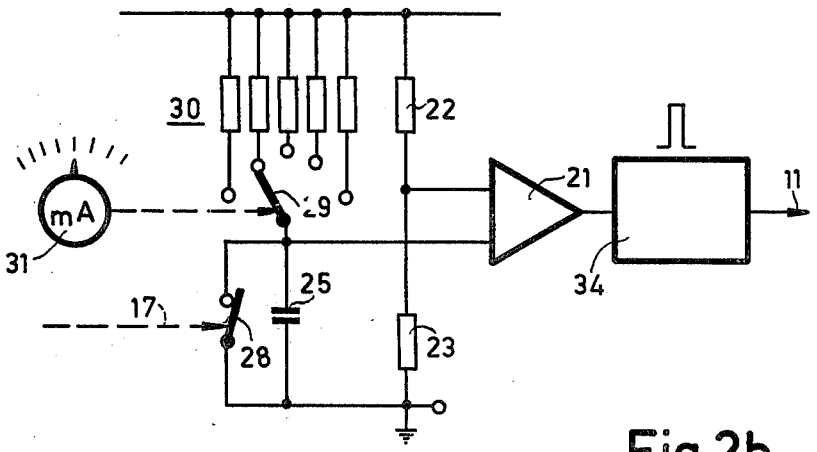
Figures 3A, 3B, 3C:
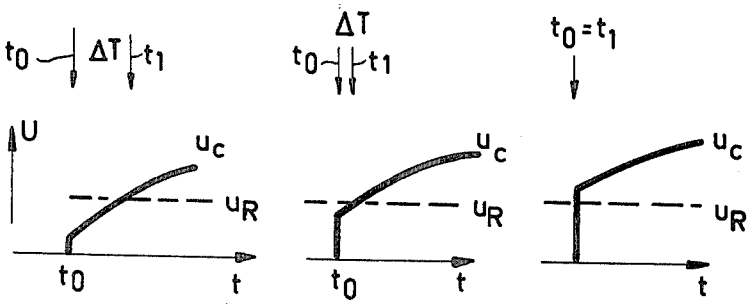
Figure 4:
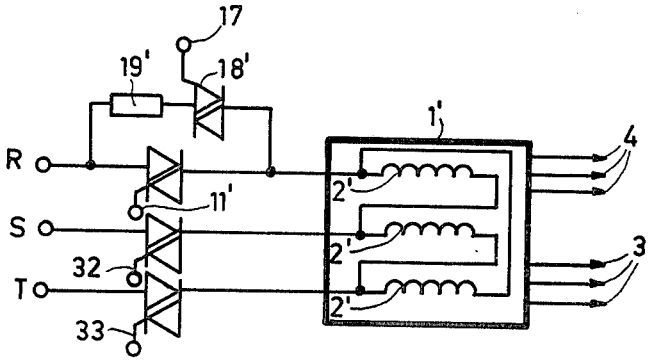

The invention will now be described in more detail with reference to the drawing in which FIG. 1 shows a circuit arrangement in accordance with the invention, FIGS. 2*a* and 2*b* show different examples of the timing network, FIGS. 3*a* to 3*c* represent the variation in time of the input voltages at different tube currents for a timing network in accordance with FIG. 2*a*, and FIG. 4 shows the primary section of a different embodiment.

FIG. 1 shows a three-phase high-voltage transformer 1 of which only the primary windings 2 are shown. The high voltage transformer may comprise two sets of secondary windings connected in star and in delta respectively and with output voltages that are each rectified by a three-phase rectifier bridge 3 and 4 respectively, as is described in the book "Principles of Diagnostic X-ray Apparatus", Philips Technical Library 1975, pages 156. The two three-phase rectifier bridges 3 and 4 are connected in series and are connected to ground directly and via a measuring resistor 5, respectively. The output direct voltage of each of the two three-phase rectifier bridges is each applied to a filter network, consisting of a resistor 6 and 7 respectively (approx. 80 kOhms) and a capacitor 8 and 9 respectively (approx. 10 nF). An X-ray tube 35 is connected between the outputs of the rectifiers 3 and 4 which carry the negative and the positive high voltage respectively.

The primary windings 2 of the high-voltage transformer 3 are connected to a control transformer, not shown, for adjusting the tube voltage, and to a three phase rectifier bridge 10. In the diagonal branch of the rectifier bridge 10 a thyristor 11 is included, which (at least partly) serves for switching on the tube voltage and which is connected in parallel with a quenching thyristor 12 in series with a quenching capacitor 13 and a limiting resistor 14. The quenching thyristor 12 receives an ignition pulse from a generator 15 when the exposure is terminated by an automatic exposure control or a timer. The capacitor then discharges via the thyristor 11 so that said thyristor is extinguished. The capacitor is subsequently recharged by a direct voltage generator 16 which may also consist of a three-phase bridge. Moreover, there is provided a generator 17 which supplies a pulse-shaped high voltage starting signal.

The part of the circuit described so far is known (DT-PS No. 15 63 553). The novel feature is that the series connection of a further thyristor 18 and a resistor 19 is connected in parallel with the thyristor 11 and that the thyristor 18 is turned on by the high-voltage starting signal supplied by the generator 17 and that the thyristor 11 is not turned on until after a delay time which is dependent on the tube current. For the delayed turn-on of the thyristor 11 a timing network 20 is used which is started by a high-voltage starting pulse supplied by the generator 17 and which, under control of a voltage drop across the resistor 5 proportional to the tube current, produces an output pulse for the ignition of the thyristor 11 with a time delay. This time delay decreases for an increasing current through the X-ray tube or in the high voltage circuit respectively and increases for a decreasing current.

For realizing a timing network which responds to a starting signal to produce an output pulse with a delay which depends on the current, there are a multiplicity of possibilities. One of these possibilities is represented by the circuit in FIG. 2*a*.

The timing network comprises a comparator circuit 21 which compares a reference voltage $u_R$ taken from the voltage divider 22, 23 with the voltage at the junction point of a resistor 24 and a capacitor 25. The lower end of the capacitor is connected to ground via the low-ohmic output of an operational amplifier 26 and via a resistor 27. The comparator 21 produces an output pulse when the voltage $u_c$ at said junction point becomes equal to or exceeds the reference voltage $u_R$. The capacitor 25 and the resistor 27 are short-circuited by an electronic switch 28 before the beginning of the exposure. This switch, as is indicated by dash lines—is opened by the high-voltage starting signal supplied by the generator 17 so that charging of the capacitor 25 begins at the same time that the high voltage is switched on. The input of the amplifier 26 is connected to the measuring resistor 5, through which a current flows which is proportional to the tube current.

The operation of the timing network can be described with reference to FIGS. 3*a* to 3*c* which show the variation of the voltage at the junction point of the capacitor 25 and the resistor 24 as a function of time. For very large tube currents the voltage drop across the resistor 5, or the output voltage of the operational amplifier 26, is so high that the low end of the capacitor 25 is brought to a potential which is positive relative to the reference voltage $u_R$. As a result the voltage $u_c$ at the junction point of the resistor 24 and the capacitor 25 immediately exceeds the reference voltage (FIG. 3*c*). If we neglect the fact that the tube current cannot rise as steeply as is shown in FIG. 3*c*, and if the switching delays of the switches 28 and the comparator circuit 21 are neglected, the output signal produced by the comparator circuit 21, which via a stage 34 which serves for pulse shaping and potential isolation turns on the thyristor 11, will coincide with the high-voltage starting signal which turns on the thyristor 18. The resistor 19 in series with the thyristor 18 is thus short-circuited by the thyristor 11 and thus cannot become operative. It is not necessary in the case of large tube currents for the resistor 19 to become operative because in that case the resonant circuit consisting of the stray inductances of the high-voltage transformer and the generator capacitances is damped so strongly that substantially no excess voltages can occur. If the by-passing by thyristor 11 were effected at a later instant, the high-voltage rise would be stepwise in accordance with the delay.

Therefore, the gain of the amplifier 26 and the reference voltage $u_R$ should be adapted to each other in such a way that for large currents the output voltage of the amplifier 26 is higher than the reference voltage $u_R$.

For average currents (FIG. 3*b*) the output voltage of the amplifier 26 is smaller than the reference voltage. Consequently, the voltage $u_c$ does not reach the reference voltage $u_R$ until the capacitor 25 has been changed to a specific level (instant $t_1$), so that a certain delay $\Delta T$ (for example 1 msec.) is obtained between turn-on of the thyristor 18 (instant $t_0$) and turn-on of the thyristor 11 at time $t_1$. The magnitude of the delay time then also depends on the time constant of the RC network which is constituted by the resistor 24 and the capacitor 25. This time constant and the resistor should be proportional so that, particularly in the medium tube-current range, no excess voltages occur. On the other hand, no voltage decrease should occur as a result of the brief inclusion of the resistor.

For still smaller tube currents (FIG. 3*a*) the capacitor voltage $u_c$ will reach the reference voltage $u_R$ even later so that the delay time ($\Delta T$) between the high-voltage starting signal of the generator 17 and the output signal of the comparator circuit 21, i.e. between turn-on of the thyristor 18 and the thyristor 11, becomes even greater. If the tube current is smaller than the current through the filter chain 6 . . . 9 (FIG. 1), a variation of the tube current has practically no more influence on the total tube current flowing in the high-voltage circuit and thus on the overshoot behaviour when the high voltage is switched on. Therefore, it is effective and permissible to measure the current through the filter chain in addition to the tube current. (In this case the low end of the capacitor 8 will be connected to ground) instead of being connected to resistor 5 so that for a further decreasing tube current substantially no change of the total current measured in the high-voltage circuit results and hence no change of the delay time.

In many cases—for example in the case of tube-current control—it is undesirable to measure the current through the filter networks 6 . . . 9 and in these cases the filter network 6 should be connected directly to the output of the bridge rectifier 4. This leads to an unnecessary prolongation of the delay time, but this does not present any problems because even if the thyristor 11 is not turned on at all during an exposure with a very small tube current, the voltage drop produced across the resistor 19 (0.3 to 1 ohm) by the tube current, after being transformed to the primary side, will be so low that it would hardly give rise to a reduction of the tube voltage.

The filter networks 6 . . . 9 in the high-voltage circuit may also be dispensed with, but then a resistor 19 of higher value has to be used in order to avoid excess voltages for small tube currents.

It is alternatively possible to connect the low end of the capacitor 25 directly to ground and to change the reference voltage $u_R$ by an amount which is dependent on the current in the high-voltage circuit. It is also possible to utilize the capacitor discharge instead of its charge characteristic, in which case the switch 28 will be opened before the tube voltage is switched on and will be closed thereafter so that the capacitor can discharge via said switch. Instead of the capacitor voltage the voltage across the charging resistor 24 may also be used. The charging resistor 24 may be replaced by a constant-current source, for example by the collector-emitter junction of a transistor whose base is connected to a constant potential.

FIG. 2*b* shows a different version of a timing network. The network again comprises a comparator or a threshold-value circuit 21, a voltage divider 22, 23 which defines a reference voltage, and the capacitor 25 which is short-circuited by the switch 28 before the start of the exposure and is thus discharged. Furthermore, there is provided a group of charging resistors 30 of which each time one resistor is connected via a switch 29 which is coupled to the tube current control 31. The delay between the high-voltage starting signal and the turn-on of the thyristor 11 and thus the interval during which the resistor 19 is included in the primary circuit is determined by the value of the included charging resistor. The charging resistors 30 are therefore proportioned so that, for the tube current or tube current range for which they are connected, neither an excess voltage nor a reduction of the voltage results. Instead of the resistor group 30 a potentiometer may be used having a wiper coupled to the tube-current control 31 and in which the potentiometer is electrically connected to the capacitor. Instead of a capacitor and a group of charging resistors it is alternatively possible to use a charging resistor and a group of capacitors.

It is also possible to realize the timing network by digital means. Such a digital timing network may, for example, comprise an oscillator, a counter, and a digital comparator circuit. The counter counts the pulses supplied by the oscillator—starting with the high voltage starting signal—and the comparator circuit compares the count with a predetermined value and when said predetermined value is reached produces a signal for turning on the thyristor 11. The oscillator comprises a voltage-frequency converter which converts a voltage which is proportional to the tube current or the current in the high-voltage circuit into a frequency which is proportional thereto or into a frequency which increases with increasing voltage and, as the case may be, also with the differential quotient of the voltage. For a larger tube current the frequency is consequently high and the predetermined value is reached very rapidly, whereas for a smaller tube current the oscillator frequency is low and the predetermined value is reached comparatively slowly.

In FIG. 1 the invention has been described in conjunction with a three-phase transformer, but the invention may also be used in X-ray generators which only comprise an a.c. transformer for a single-phase alternating voltage. In the case of the three-phase transformer shown in FIG. 1 a three-phase rectifier bridge 10 is connected to the star point of the three windings, the diagonal branch of said bridge including thyristors 11 and 18. However, the invention may also be used in X-ray generators with a high-voltage transformer whose primary windings are connected differently.

An example of this is shown in FIG. 4. In this case 1' designates a three-phase transformer, which shows only the primary windings 2' connected in delta. The secondary windings (not shown) may be connected in the same way as explained with reference to FIG. 1. The three-phase voltages R, S, T of the three-phase AC supply are each applied to the three primary windings 2' of the three-phase transformer 1' via a triac 11', 32 and 33 respectively. The triac 11' is connected in parallel with the series connection of a triac 18' and a resistor 19'. The triacs 18', 32 and 33 can only be turned on at a specific instant with respect to the phase of one of the phase voltages. Such an arrangement of the primary windings is in principle known from DT-PS No. 11 83 998. However, in this circuit electromechanical switches are used instead of triacs.

The thyristors 18', 32 and 33 are always turned on at a predetermined phase relationship of the AC supply voltage, such that the windings connected to the R-phase contribute the greater part in the formation of the direct voltage at the output of the high-voltage rectifier bridge. For example, if the secondary windings (not shown) of the three-phase transformer 1 are connected in delta, the turn-on moment coincides with the zero passage of the phase-voltage T, which leads the phase-voltage R by 120°, or said moment may occur slightly before said zero passage. The timing network, which may be of the same design as described with reference to the preceding Figures, ignites the triac 11' after a time which depends on the tube current or the current in the high-voltage circuit, and which increases as the tube current or the current in the high-voltage circuit decreases. When the high voltage is switched on the resistor 19' damps the resonant circuit which is constituted by the stray inductance of the high-voltage transformer and the generator capacitances. Now if the timing network is proportioned so that the time interval during which the resistor 19' is included suitably depends on the tube current or the current in the high-voltage circuit, the turn-on transient may also be eliminated with the arrangement shown in FIG. 4 without the high voltage being reduced below the preset value during the inclusion of the resistor 19'.

What is claimed is:

1. In an X-ray generator having an X-ray tube, a circuit comprising, a high voltage transformer having a primary winding circuit for coupling to an AC power supply and a secondary winding circuit for energizing the X-ray tube via a high voltage circuit, a first electronic switch connected in the transformer primary winding circuit so as to switch the voltage to the X-ray tube on and off, a second electronic switch and a resistor connected in a series circuit, means connecting said series circuit in parallel with the first electronic switch, means for supplying a start signal for the high voltage to the second switch so as to activate said second switch at the start of an X-ray exposure period, a timing network having an input coupled to receive the high-voltage start signal for starting the timing network and an output for supplying an output signal to activate the first electronic switch, said timing network including means for varying the delay time between the high-voltage start signal and the output signal so that said delay time varies inversely with the amplitude of current in said high voltage circuit.

2. A circuit as claimed in claim 1 wherein the X-ray generator includes a tube current control device and the timing network comprises a plurality of impedance elements individually selectable to determine the delay time and arranged so that each time one element can be made operative by means of the tube current control device.

3. A circuit as claimed in claim 1 wherein the timing network comprises a capacitor, a source of reference voltage, a charge-discharge circuit coupled to the capacitor, a comparator circuit which produces the output signal for activating the first switch and which compares the capacitor voltage with the reference voltage, and means for varying either the potential at one terminal of the capacitor or the reference voltage by an amount proportional to the current measured in the high-voltage circuit or the tube current.

4. A circuit as claimed in claims 1, 2 or 3 further comprising at least one high-voltage rectifier circuit connected to the secondary circuit of the high-voltage transformer, and a filter network comprising a series connection of a resistor and a capacitor connected to an output of the high-voltage rectifier circuit.

5. An X-ray apparatus comprising, an X-ray tube, a high voltage transformer having a primary winding circuit for coupling to an AC power supply and a secondary winding circuit coupled to the X-ray tube via a high voltage circuit, a first controlled switch connected in the transformer primary winding circuit so as to switch the voltage to the X-ray tube on and off, a second controlled switch and a resistor connected in a series circuit, means connecting said series circuit in parallel with the first controlled switch, means for generating a start signal, a timing network coupled to said high voltage circuit and including means for varying the delay time between the application of a start signal at an input thereof and the appearance of an output signal at an output thereof so that the dealy time varies inversely with the amplitude of current in said high voltage circuit, means coupling the start signal to an input of the timing network and to a control terminal of the second controlled switch, and means coupling the output signal of the timing network to a control terminal of the first controlled switch.

6. An X-ray apparatus as claimed in claim 6 wherein the timing network comprises, a capacitor, a charge circuit and a discharge circuit coupled to the capacitor, a source of reference voltage, a comparison circuit having first and second inputs coupled to said capacitor and to said source of reference voltage, respectively, and an output for deriving said output signal for control of the first controlled switch, means for generating a voltage pulse that is variable in amplitude in accordance with the current level in the high voltage circuit or the tube current, and means coupling said voltage pulse to alter the voltage level of either the capacitor or the reference voltage in synchronism with said start signal.

7. An X-ray apparatus as claimed in claim 6 further comprising means for adjusting the level of current in the X-ray tube, and resistor means coupled to the capacitor to form a variable RC circuit, said RC circuit being responsive to said current adjusting means to vary the time constant thereof as a function of the tube current setting.

* * * * *